US007836517B2

(12) United States Patent
Durocher et al.

(10) Patent No.: US 7,836,517 B2
(45) Date of Patent: Nov. 23, 2010

(54) FACE GUARD FOR A HOCKEY HELMET

(75) Inventors: Jacques Durocher, St-Jérôme (CA); Marie-Claude Généreux, Ste-Thérèse (CA); Jean-François Laperrière, Prévost (CA)

(73) Assignee: Bauer Hockey, Inc., Greenland, NH (US)

( * ) Notice: Subject to any disclaimer, the term of this patent is extended or adjusted under 35 U.S.C. 154(b) by 485 days.

(21) Appl. No.: 11/730,213

(22) Filed: Mar. 30, 2007

(65) Prior Publication Data

US 2007/0214537 A1 Sep. 20, 2007

Related U.S. Application Data

(63) Continuation-in-part of application No. 11/211,668, filed on Aug. 26, 2005, now Pat. No. 7,765,608.

(51) Int. Cl.
*A42B 3/20* (2006.01)

(52) U.S. Cl. ..... 2/9

(58) Field of Classification Search ..... 2/424, 2/9, 410, 425, 421, 455, 173, 909
See application file for complete search history.

(56) References Cited

U.S. PATENT DOCUMENTS 4,631,758 A * 12/1986 Newman et al. ..... 2/424
6,338,165 B1 1/2002 Biondich
6,421,829 B2 7/2002 Halstead et al.
6,763,524 B2 7/2004 Halstead et al.
7,127,747 B2 * 10/2006 Darnell et al. ..... 2/426
2006/0053520 A1 3/2006 Bologna
2006/0185066 A1 8/2006 Page et al.
2007/0044193 A1 3/2007 Durocher et al.

* cited by examiner

*Primary Examiner*—Tejash Patel

(57) ABSTRACT

The invention provides a face guard for a hockey helmet. The face guard comprises a contour wire and a plurality of wires made of stainless steel. The plurality of wires are arranged as a curved grid having a concave side for facing a face of a wearer, the plurality of wires comprising first, second, third and fourth vertical wires intersecting first and second horizontal wires, each of the first, second, third and fourth vertical wires and first and second horizontal wires having a portion to be at least partially located within a field of view of the eyes of the wearer, each of the first, second, third and fourth vertical wires and first and second horizontal wires having an inner surface facing the face of the wearer and an outer surface opposing the inner surface, wherein the inner surface is mat and the outer surface is shiny. Each of the first, second, third and fourth vertical wires and first and second horizontal wires may have an elliptical cross-section with a major axis and a minor axis, the major axis being oriented to generally converge towards the eyes of the wearer, wherein a ratio of the minor axis to the major axis is between 0.4 and 0.8, and wherein the face guard weighs between 170 grams and 220 grams.

24 Claims, 8 Drawing Sheets

FACE GUARD FOR A HOCKEY HELMET

The present application is a continuation-in-part of U.S. patent application Ser. No. 11/211,668 to Durocher et al. filed on Aug. 26, 2005 now U.S. Pat. No. 7,765,608 and hereby incorporated by reference herein.

FIELD OF THE INVENTION

The present invention relates to a face guard for a hockey helmet.

BACKGROUND OF THE INVENTION

A protective helmet is often used to protect a wearer's head during practice of a sport such as hockey, lacrosse, ringette, football and baseball. A protective helmet sometimes comprises a face guard for protecting a wearer's face against impact with an object such as a hockey implement (e.g. a stick, a bat, etc.), a puck, a ball, or any other object involved in a given sport.

One type of face guard is a wire face guard, which includes a series of horizontal and vertical wires defining a protective grid extending in front of the wearer's face. The wires are dimensioned and configured so as to prevent an object from passing through the protective grid and impacting the wearer's face. For instance, in hockey, the wires are dimensioned and configured so as to prevent a hockey stick blade or puck from passing through the protective grid and impacting the wearer's face.

Wires of existing face guards are typically made of steel and have a circular cross-section with a diameter sufficiently large to meet strength and impact resistance requirements established by standards organizations. However, this requirement placed on the diameter of wires negatively affects visibility of the wearer since it results in wires being more obstructive to vision.

There is therefore a need for a face guard providing improvements in terms of visibility of the wearer while still providing sufficient strength and impact resistance.

SUMMARY OF THE INVENTION

As embodied and broadly described therein, the invention provides a face guard for a hockey helmet. The face guard comprises a contour wire and a plurality of wires made of stainless steel. The plurality of wires are arranged as a curved grid having a concave side for facing a face of a wearer, the plurality of wires comprising first, second, third and fourth vertical wires intersecting first and second horizontal wires, each of the first, second, third and fourth vertical wires and first and second horizontal wires having a portion to be at least partially located within a field of view of the eyes of the wearer, each of the first, second, third and fourth vertical wires and first and second horizontal wires having an inner surface facing the face of the wearer and an outer surface opposing the inner surface, wherein the inner surface is mat and the outer surface is shiny.

The invention further provides a face guard for a hockey helmet. The face guard comprises a contour wire and a plurality of wires made of stainless steel. The plurality of wires are arranged as a curved grid having a concave side for facing a face of a wearer, the plurality of wires comprising first, second, third, fourth, fifth, sixth, seventh and eighth vertical wires intersecting first, second, third and fourth horizontal wires, each of the first, second, third and fourth vertical wires and first and second horizontal wires having a portion to be at least partially located within a field of view of the eyes of the wearer, each of the first, second, third and fourth vertical wires and first and second horizontal wires having an elliptical cross-section with a major axis and a minor axis, the major axis being oriented to generally converge towards the eyes of the wearer, wherein a ratio of the minor axis to the major axis is between 0.4 and 0.8, and wherein the face guard weighs between 170 grams and 220 grams.

The invention also provides a face guard for a hockey helmet. The face guard comprises a contour wire and at least six vertical wires intersecting at least four horizontal wires for defining a curved grid having a concave side for facing a face of a wearer, wherein each of the contour wire, six vertical wires and four horizontal wires is made of stainless steel and has an inner surface facing the face of the wearer and an outer surface opposing the inner surface, and wherein the inner surface is mat and the outer surface is shiny.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of specific embodiments of the present invention is provided herein below, by way of example only, with reference to the accompanying drawings, in which.

Figure 2:
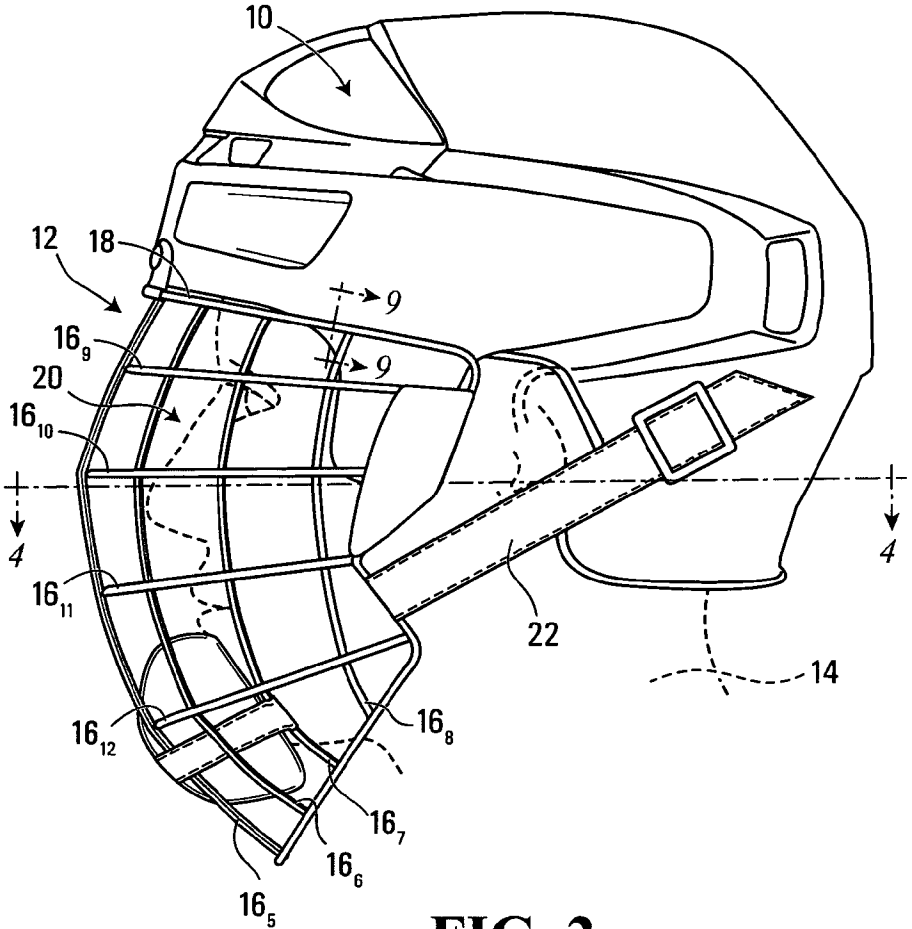
FIG. 2 is a right side elevational view of the helmet and face guard of FIG. 1.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

Figure 1:
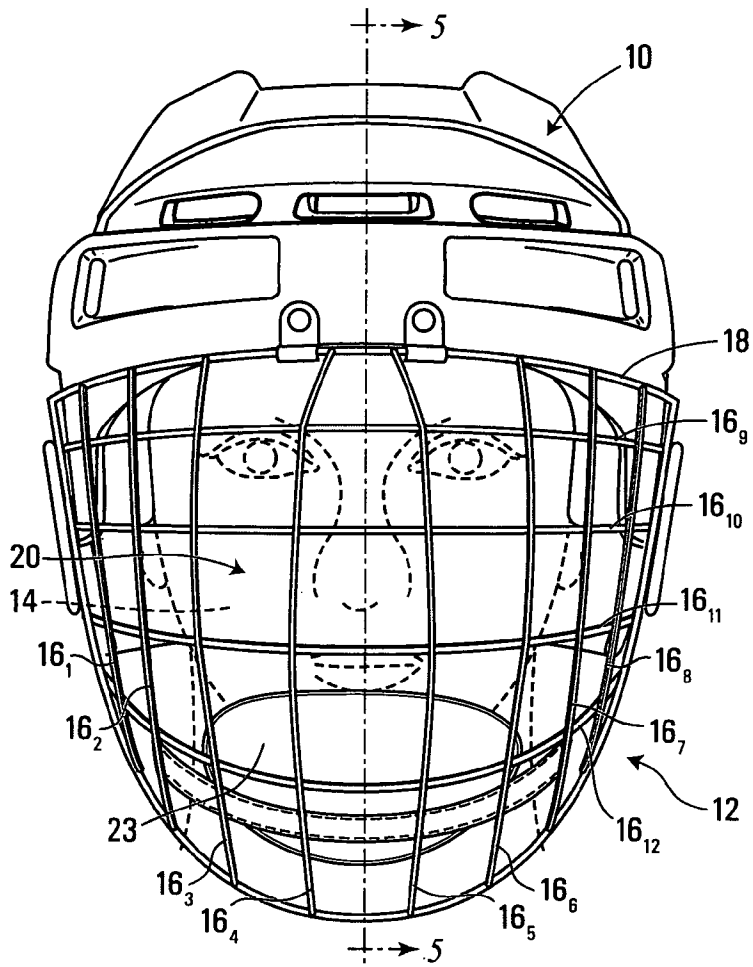
FIG. 1 is a front elevational view of a helmet having a face guard in accordance with an embodiment of the present invention.
Figure 3:
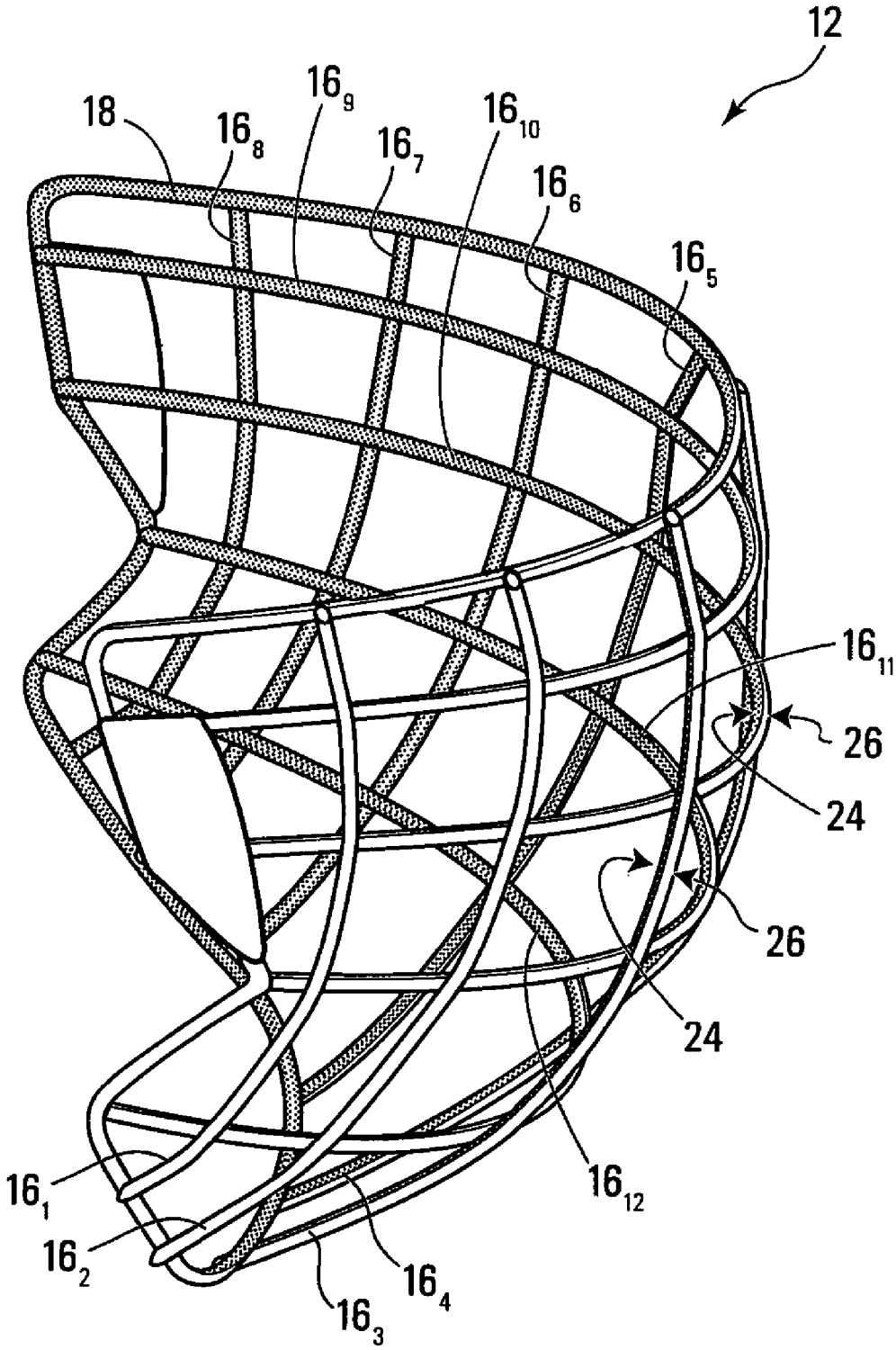
FIG. 3 is a perspective view of the face guard of FIG. 1.
Figure 4:
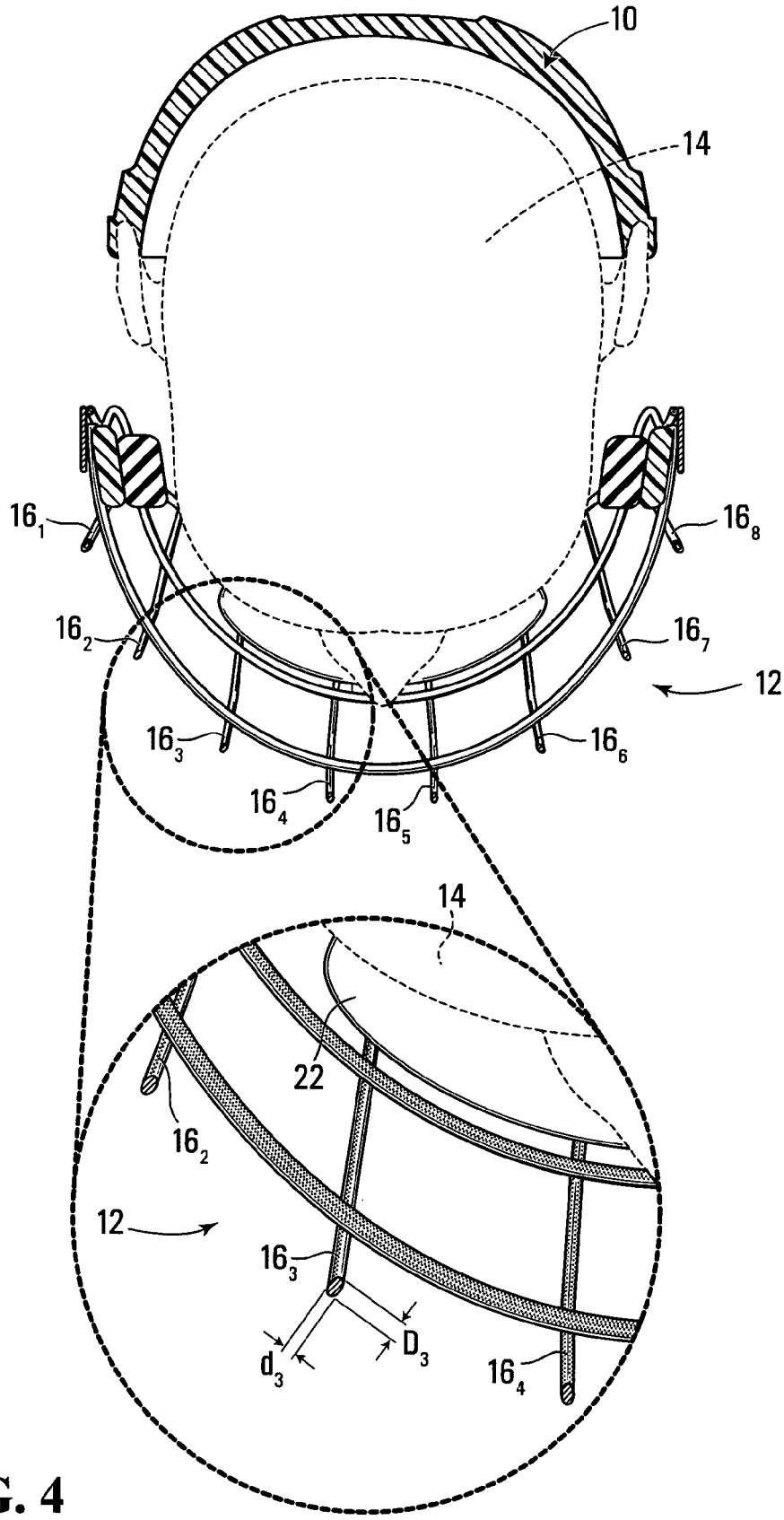
FIG. 4 is a cross-sectional plan view of the helmet and face guard of FIG. 2, taken along line 4-4.
Figure 5:
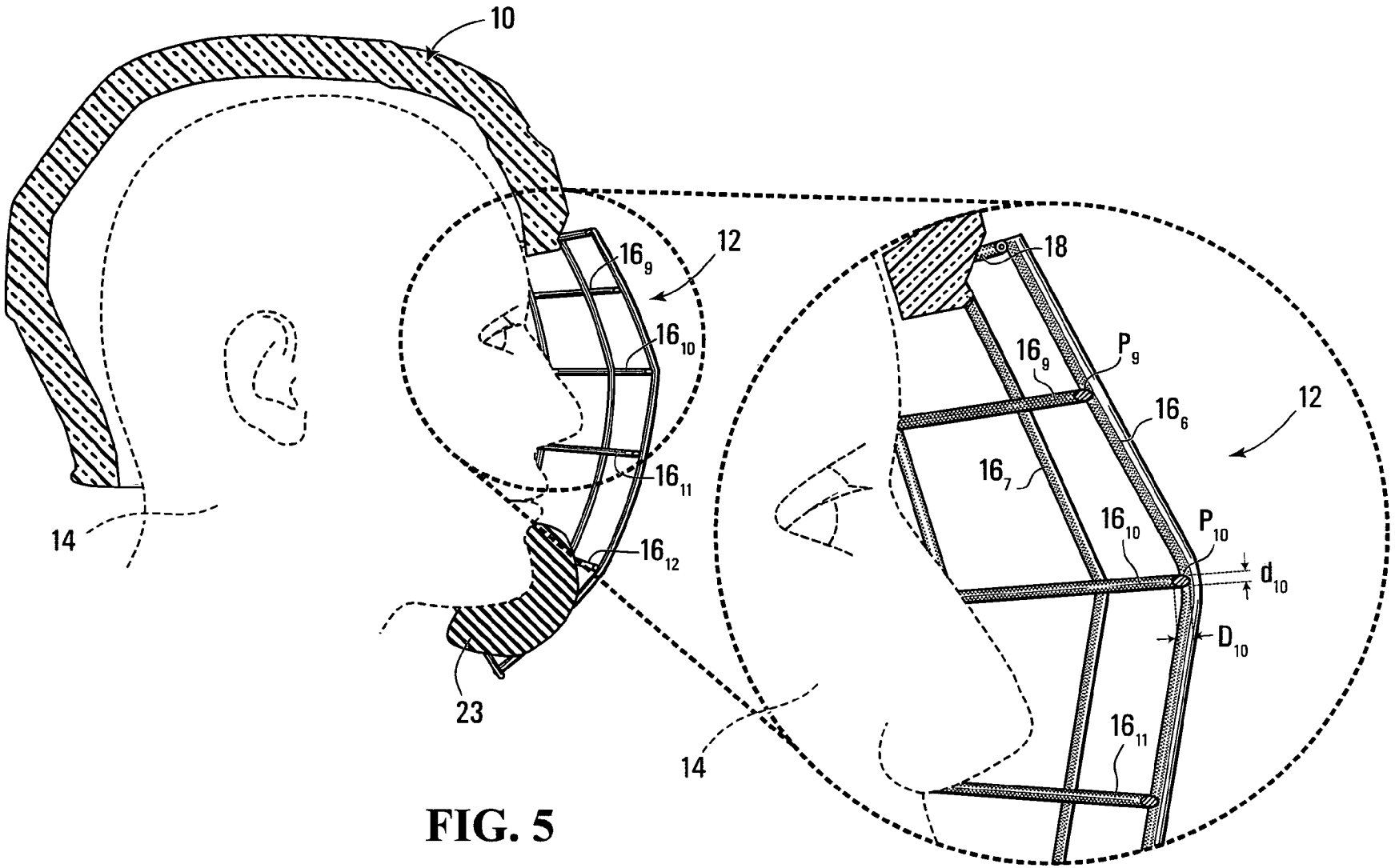
FIG. 5 is a cross-sectional elevational view of the helmet and face guard of FIG. 1, taken along line 5-5.
Figure 6A:
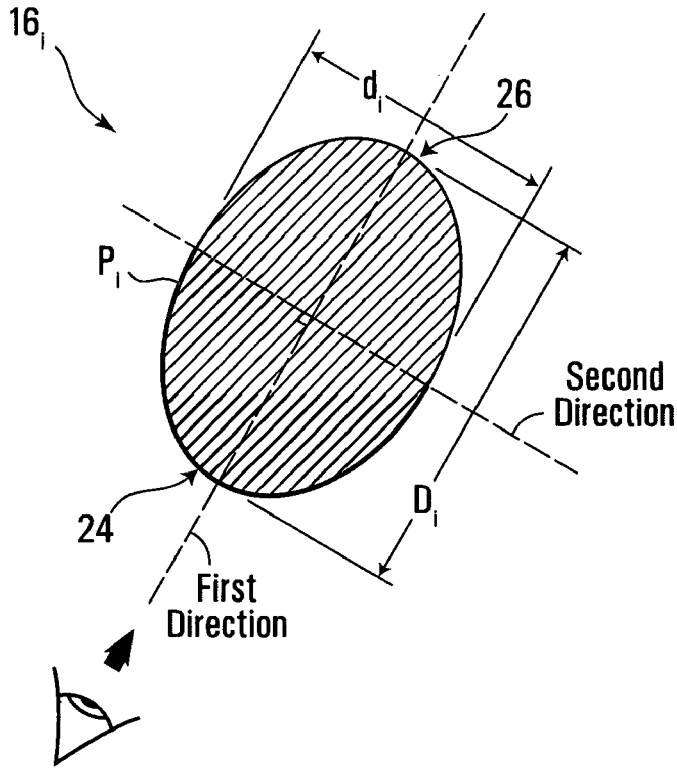
FIG. 6A is a diagrammatic representation of a cross-section of a wire of the face guard of FIG. 1.
Figure 6B:
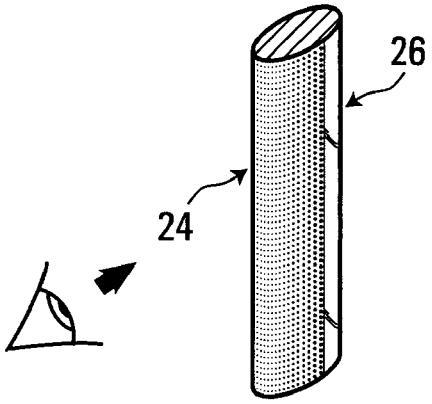
FIGS. 6B and 6C are cut away views of the wire of FIG. 6A showing its inner surface, which is mate, and its outer surface, which is shiny.
Figure 6C:
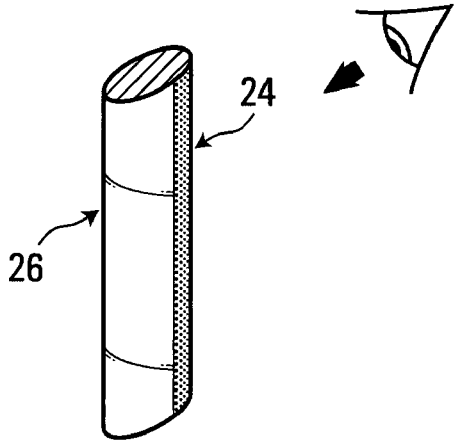

FIGS. 1 and 2 show a hockey helmet 10 to which is coupled a face guard 12 in accordance with an embodiment of the invention. The face guard 12 is for protecting the face of a wearer 14 against impact with a hockey stick blade or puck when the wearer 14 plays hockey.

Referring to FIGS. 1 to 5, the face guard 12 comprises a plurality of wires $\mathbf{16}_1$-$\mathbf{16}_{12}$ arranged as a grid and a contour wire 18. The grid may be a curved grid having a concave side for facing the face of the wearer 14. The wires $\mathbf{16}_1$-$\mathbf{16}_8$ are generally vertical, the wires $\mathbf{16}_9$-$\mathbf{16}_{12}$ are generally horizontal, and together they define a plurality of apertures 20, each sized and configured to prevent a hockey stick blade or a hockey puck from impacting the face of the wearer 14. The face guard 12 may be pivotally coupled to the hockey helmet 10 at an upper portion of the contour wire 18 and coupled to the hockey helmet 10 via adjustable straps 22. The face guard 12 may also be provided with a chin pad 23 for engaging the chin of the wearer 14 so as to fit comfortably over the face of the wearer 14.

The wires $\mathbf{16}_1$-$\mathbf{16}_{12}$ and the contour wire 18 are made of stainless steel (e.g. SAE grade 304 or 316) and may be interconnected to each other via welding. The wires $\mathbf{16}_1$-$\mathbf{16}_{12}$ and the contour wire 18 are formed, for example, by bending, to provide a concave side to the face guard 12 such that the face guard 12 is spaced apart from the face of the wearer 14.

As best shown in FIGS. 3, 6A, 6B, and 6C, each of the wires $\mathbf{16}_1$-$\mathbf{16}_{12}$ has an inner surface 24 facing the face of the wearer and an outer surface 26 opposing the inner surface 24. While the inner surface 24 is mat in order to improve the vision of the wearer by absorbing light or reducing the glare from lighting, the outer surface 26 is shiny in order to create a metallic surface contrast between the outer surface 26 and the inner surface 24 and to render the face guard more visually appealing. To obtain an outer surface having a shiny aspect, the outer surfaces of the wires can be polished, shined or buffed. That is, a treatment can be performed on the outer surfaces of the wires to make them shiny, while no such treatment is performed on the inner surface of these wires, which remains mat. It is understood that the inner surface 24 is mat and the outer surface 26 is shiny in a permanent fashion after construction of the face guard is completed. Because no paint is applied to the wires, the face guard may be slightly lighter and may not be subject to chipping that usually occurs when objects such as hockey stick blades, blades or pucks impact the guard.

As described below, the wires $\mathbf{16}_1$-$\mathbf{16}_{12}$ may also be configured and dimensioned so as to provide optimal visibility to the wearer 14, while providing sufficient strength and rigidity for impact resistance.

Figure 7:
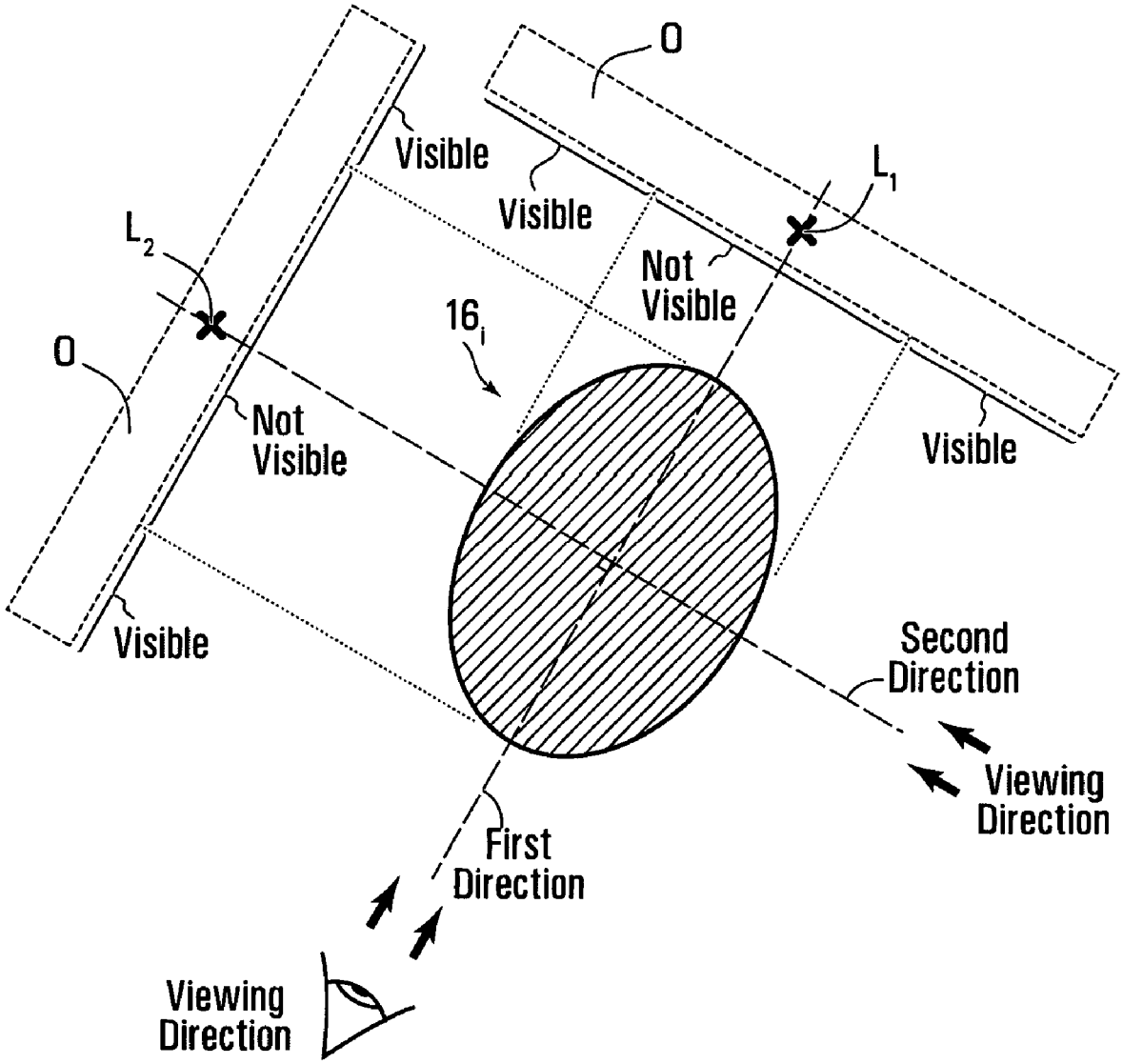
FIG. 7 is a diagrammatic representation illustrating that the wire of FIG. 6A is less obstructive to vision along a first direction than along a second direction.

As best seen in FIGS. 4 to 6A, each of the vertical wires $\mathbf{16}_3$, $\mathbf{16}_4$, $\mathbf{16}_5$, $\mathbf{16}_6$ and horizontal wires $\mathbf{16}_{10}$, $\mathbf{16}_{11}$ has a cross-section with a periphery $P_i$ having a first maximal dimension $D_i$ in a first direction and a second maximal dimension $d_i$ in a second direction intersecting the first direction (where i=3, 4, 5, 6, 10 or 11). The second direction may intersect the first direction at an angle of 90°. It should be understood that the second direction may intersect the first direction at an angle between 70° and 120° depending of the shape of the wire. For a given wire $\mathbf{16}_i$, the second maximal dimension $d_i$ is less than the first maximal dimension $D_i$ such that the given wire $\mathbf{16}_i$ is less obstructive to vision along the first direction than along the second direction. That is, as shown in FIG. 7, if the given wire $\mathbf{16}_i$ is viewed along the first direction and an object O is located at a location $L_1$ behind the given wire $\mathbf{16}_i$ and intersecting the first direction, a greater portion of the object O will be visible than if the given wire $\mathbf{16}_i$ is viewed along the second direction and the object O is located at a location $L_2$ behind the given wire $\mathbf{16}_i$ and intersecting the second direction.

Figure 8A:
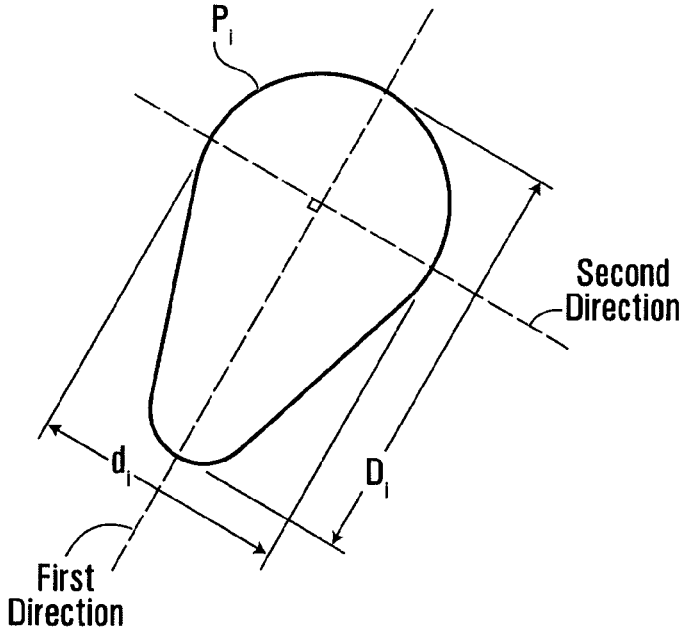
FIGS. 8A to 8C illustrate possible cross-section configurations for a wire of a face guard in accordance with other embodiments of the present invention.
Figure 8B:
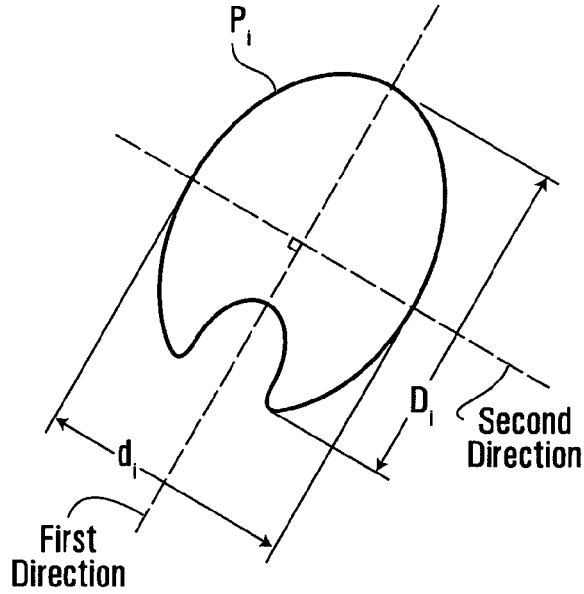
Figure 8C:
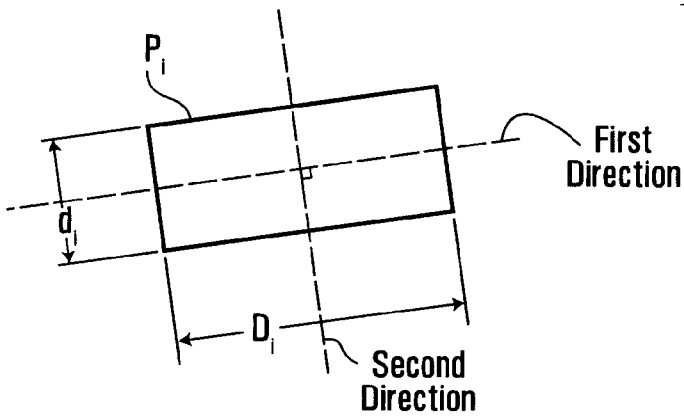

In the embodiment shown in FIGS. 1 to 6C, the periphery $P_i$ of a given wire $\mathbf{16}_i$ is an ellipse (i.e. the wire has an elliptical cross-section), the first maximal dimension $D_i$ being the major axis of the ellipse and the second maximal dimension $d_i$ being the minor axis of the ellipse. In other embodiments, the periphery $P_i$ of a given wire $\mathbf{16}_i$ may have various other non-elliptical configurations. FIGS. 8A to 8C illustrate examples of possible non-elliptical configurations for the periphery $P_i$ of a given wire $\mathbf{16}_i$, which may be curved or polygonal, as well as the first maximal dimension $D_i$ and the second maximal dimension $d_i$ in each case.

A ratio $d_i/D_i$ between 0.4 and 0.8 has been found advantageous. A ratio $d_i/D_i$ between 0.5 and 0.7 has been found particularly advantageous. However, it should be understood that, generally, any ratio $d_i/D_i$ less than one may be envisaged without departing from the scope of the invention. The first maximal dimension $D_i$ may be between 3.4 mm and 4.4 mm while the second maximal dimension $d_i$ may be between 1.8 mm and 2.8 mm.

Reverting to FIGS. 1 to 5, each of the wires $\mathbf{16}_3$-$\mathbf{16}_6$ and $\mathbf{16}_{10}$-$\mathbf{16}_{11}$ has an elliptic periphery $P_i$ and at least a portion located in a field of view of the wearer 14. To achieve optimal visibility for the wearer 14, the major axis $D_i$ of the periphery $P_i$ of a given wire $\mathbf{16}_i$ may be aligned with a line of sight of the wearer 14 when directly looking at that given wire $\mathbf{16}_i$. However, this may not always be achievable since different wearers may have different lines of sight for the same given wire $\mathbf{16}_i$. Therefore, to accommodate different wearers, the wires $\mathbf{16}_3$-$\mathbf{16}_6$ and $\mathbf{16}_{10}$-$\mathbf{16}_{11}$ are oriented such that their respective major axes generally converge towards the approximate location of the eyes of a wearer when he/she wears a hockey helmet with the face guard 12.

Each of the wires vertical wires $\mathbf{16}_1$, $\mathbf{16}_2$, $\mathbf{16}_7$, $\mathbf{16}_8$ and horizontal wires $\mathbf{16}_9$, $\mathbf{16}_{12}$ may also have a cross-section with a periphery $P_i$ having a first maximal dimension $D_i$ in a first direction and a second maximal dimension $d_i$ in a second direction intersecting the first direction (where i=1, 2, 7, 8, 9 and 12). For a given wire $\mathbf{16}_i$, the second maximal dimension $d_i$ is less than the first maximal dimension $D_i$ such that the given wire $\mathbf{16}_i$ is less obstructive to vision along the first direction than along the second direction. In the embodiment shown in FIGS. 1 to 6C, the periphery $P_i$ of a given wire $\mathbf{16}_i$ is an ellipse, the first maximal dimension $D_i$ being the major axis of the ellipse and the second maximal dimension $d_i$ being the minor axis of the ellipse. A ratio $d_i/D_i$ between 0.4 and 0.8 has been found advantageous. A ratio $d_i/D_i$ between 0.5 and 0.7 has been found particularly advantageous. However, it should be understood that, generally, any ratio $d_i/D_i$ less than one may be envisaged without departing from the scope of the invention. The first maximal dimension $D_i$ may be between 3.4 mm and 4.4 mm while the second maximal dimension $d_i$ may be between 1.8 mm and 2.8 mm.

Figure 9:
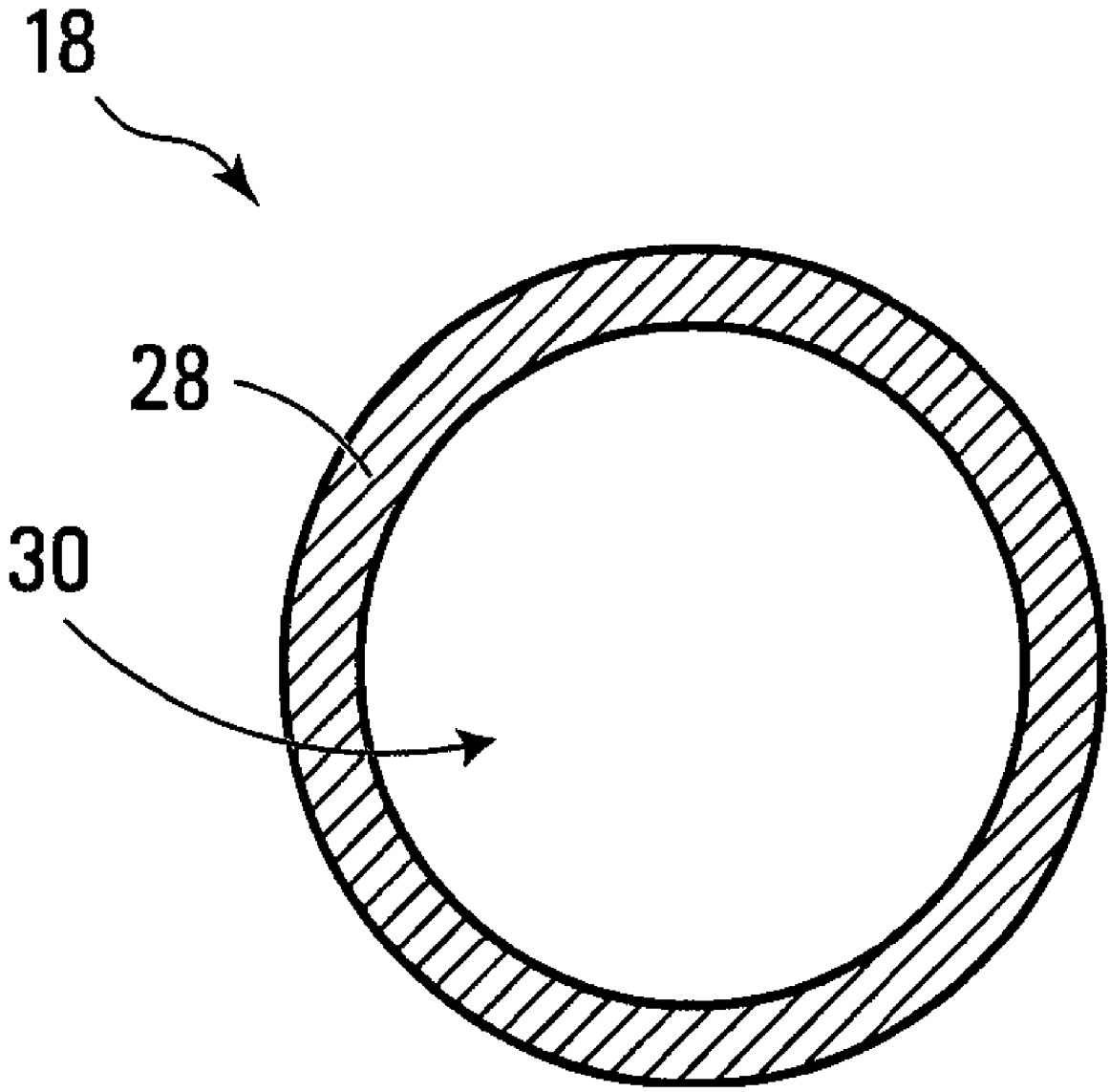
FIG. 9 is a diagrammatic representation of a cross-section of a contour wire of the face guard of FIG. 2, taken along line 9-9.

As best seen in FIG. 9, the contour wire 18 may have a peripheral wall 28 defining a hollow interior 30 and a circular periphery with a diameter between 2.8 mm and 3.2 mm. The thickness of the peripheral wall may be between 0.6 mm and 1.0 mm.

It will thus be appreciated that the wires $\mathbf{16}_1$-$\mathbf{16}_{12}$ of the face guard 12 are configured and dimensioned so as to provide benefits in terms of visibility to the wearer 14 and weight of the face guard 12, without compromising rigidity and strength for impact resistance.

In this regard, for a face guard made of stainless steel and having (i) a contour wire with a diameter of 3.2 mm and a peripheral wall 28 defining a hollow interior and having a thickness of 0.8 mm; and (ii) eight (8) vertical wires (e.g. $\mathbf{16}_1$-$\mathbf{16}_8$) and four (4) horizontal wires (e.g. $\mathbf{16}_9$-$\mathbf{16}_{12}$), each having an elliptical cross-section with a minor axis of between 1.8 mm and 2.8 mm and a major axis between 3.4 mm and 4.4 mm, it is possible to make such face guard such that it weighs between 170 grams and 220 grams. Moreover, vertical and/or horizontal wires having an elliptical cross-section and vertical and/or horizontal wires having a peripheral wall defining a hollow interior, can also be used in combination in order to obtain a face guard of stainless steel that weighs between 170 grams and 220 grams. For example, in the above embodiment, the wires $\mathbf{16}_3$-$\mathbf{16}_6$ and $\mathbf{16}_{10}$, $\mathbf{16}_{11}$ can have an elliptical cross-section while the wires $\mathbf{16}_1$, $\mathbf{16}_2$, $\mathbf{16}_7$, $\mathbf{16}_8$, $\mathbf{16}_9$, $\mathbf{16}_{12}$ and the contour wire 18 may have a peripheral wall defining a hollow interior.

Although in the embodiment shown in FIGS. 1 to 5, the face guard 12 comprises one contour wire and twelve (12) wires defining the grid, it is to be understood that, in other embodiments, the face guard 12 may comprise one contour wire and eleven (11) or thirteen (13) wires without departing from the scope of the invention. A person skilled in the art will appreciate that the number and configuration of the wires must be selected for defining a grid that will prevent a hockey stick blade or puck from impacting the face of the wearer 14 and that will resist impact/penetration tests such as CAN/CSA-Z262.2-M90.

Although various embodiments have been illustrated, this was for the purpose of describing, but not limiting, the invention. Various modifications will become apparent to those skilled in the art and are within the scope of the present invention, which is defined more particularly by the attached claims.

The invention claimed is:

1. A face guard for a hockey helmet, said face guard comprising a contour wire and a plurality of welded wires made of stainless steel, said plurality of welded wires being arranged as a curved grid having a concave side for facing a face of a hockey player and having a plurality of apertures, each aperture being sized and configured for preventing a hockey stick or puck from impacting the hockey player's face, said plurality of plurality wires comprising first, second, third and fourth vertical wires intersecting first and second horizontal wires, each of said first, second, third and fourth vertical wires and first and second horizontal wires having a portion to be at least partially located within a field of view of the eyes of the player, each of said first, second, third and fourth vertical wires and first and second horizontal wires having an inner surface facing the face of the player and an outer surface opposing said inner surface, wherein said inner surface is mat and said outer surface is shiny.

2. A face guard as defined in claim 1, wherein each of said first, second, third and fourth vertical wires and first and second horizontal wires has a cross-section with a periphery having a respective first maximal dimension in a respective first direction and a respective second maximal dimension in a respective second direction intersecting the first direction and wherein said first maximal dimension is greater than said second maximal dimension.

3. A face guard as defined in claim 2, wherein said second maximal dimension is between 1.8 mm and 2.8 mm and said first maximal dimension is between 3.4 mm and 4.4 mm.

4. A face guard as defined in claim 2, wherein a ratio of said second maximal dimension to said first maximal dimension is between 0.4 and 0.8.

5. A face guard as defined in claim 1, wherein each of said first and second horizontal wires has an elliptical cross-section with a major axis and a minor axis, and wherein said first and second horizontal wires are oriented such that their respective major axes generally converge towards the eyes of the player.

6. A face guard as defined in claim 3, wherein said plurality of wires comprises third and fourth horizontal wires intersecting said first, second, third and fourth vertical wires, wherein each of said third and fourth horizontal wires has a cross-section with a periphery having a respective first maximal dimension in a respective first direction and a respective second maximal dimension in a respective second direction intersecting the first direction, said second maximal dimension of each of said third and fourth horizontal wires being between 1.8 mm and 2.8 mm and said first maximal dimension of each of said third and fourth horizontal wires being between 3.4 mm and 4.4 mm.

7. A face guard as defined in claim 6, wherein each of said first, second, third and fourth horizontal wires has an elliptical cross-section with a major axis and a minor axis, and wherein said first, second, third and fourth horizontal wires are oriented such that their respective major axes generally converge towards the eyes of the player.

8. A face guard as defined in claim 6, wherein said plurality of wires comprises fifth and sixth vertical wires intersecting said first, second, third and fourth horizontal wires, wherein each of said fifth and sixth wires has a cross-section with a periphery having a respective first maximal dimension in a respective first direction and a respective second maximal dimension in a respective second direction intersecting the first direction, said second maximal dimension of each of said fifth and sixth wires being between 1.8 mm and 2.8 mm and said first maximal dimension of each of said fifth and sixth wires being between 3.4 mm and 4.4 mm.

9. A face guard as defined in claim 3, wherein said face guard further comprises fifth, sixth, seventh and eighth vertical wires and third horizontal wire and weighs between 170 grams and 220 grams.

10. A face guard as defined in claim 9, further comprising a fourth horizontal wire.

11. A face guard as defined in claim 8, wherein said contour wire has a peripheral wall defining a hollow interior, said peripheral wall having a thickness between 0.6 mm and 1.0 mm.

12. A face guard as defined in claim 11, wherein said contour wire has a circular periphery with a diameter between 2.8 mm and 3.2 mm.

13. A face guard as defined in claim 12, wherein said face guard weighs between 170 grams and 220 grams.

14. A face guard as defined in claim 1, wherein said face guard further comprises fifth, sixth, seventh and eighth vertical wires and third and fourth horizontal wires, each of said fifth, sixth, seventh and eighth vertical wires and third and fourth horizontal wires having an inner surface facing the face of the player and an outer surface opposing said inner surface, wherein said inner surface of said fifth, sixth, seventh and eighth vertical wires and third and fourth horizontal wires is mat and said outer surface of said fifth, sixth, seventh and eighth vertical wires and third and fourth horizontal wires is shiny.

15. A face guard for a hockey helmet, said face guard comprising a contour wire and a plurality of welded wires made of stainless steel, said plurality of welded wires being arranged as a curved grid having a concave side for facing a face of a hockey player and having a plurality of apertures, each aperture being sized and configured for preventing a hockey stick or puck from impacting the hockey player's face, said plurality of plurality wires comprising first, second, third, fourth, fifth, sixth, seventh and eighth vertical wires intersecting first, second, third and fourth horizontal wires, each of said first, second, third and fourth vertical wires and first and second horizontal wires having a portion to be at least partially located within a field of view of the eyes of the player, each of said first, second, third and fourth vertical wires and first and second horizontal wires having an elliptical cross-section with a major axis and a minor axis, said major axis being oriented to generally converge towards the eyes of the player, wherein a ratio of said minor axis to said major axis is between 0.4 and 0.8, and wherein said face guard weighs between 170 grams and 220 grams, wherein each of said first, second, third, fourth, fifth, sixth, seventh and eight vertical wires and first, second, third and fourth horizontal wires has an inner surface facing the face of the player and an outer surface opposing said inner surface, said inner surface being mat and said outer surface being shiny.

16. A face guard as defined in claim 15, wherein each of said third and fourth horizontal wires has an elliptical cross-section with a major axis and a minor axis, said major axis of each of said third and fourth horizontal wires being oriented to generally converge towards the eyes of the player, and wherein a ratio of said minor axis of each of said third and fourth horizontal wires to said major axis of each of said third and fourth horizontal wires is between 0.4 and 0.8.

17. A face guard as defined in claim 16, wherein said contour wire has a peripheral wall defining a hollow interior, said peripheral wall having a thickness between 0.6 mm and 1.0 mm.

18. A face guard as defined in claim 17, wherein said contour wire has a circular periphery with a diameter between 2.8 mm and 3.2 mm.

19. A face guard as defined in claim 15, wherein each of said third and fourth horizontal wires has an elliptical cross-section with a major axis and a minor axis, said major axis of each of said third and fourth horizontal wires being oriented to generally converge towards eyes of the player, and wherein a ratio of said minor axis of each of said third and fourth horizontal wires to said major axis of each of said third and fourth horizontal wires is between 0.4 and 0.8.

20. A face guard as defined in claim 19, wherein said contour wire has a peripheral wall defining a hollow interior, said peripheral wall having a thickness between 0.6 mm and 1.0 mm.

21. A face guard as defined in claim 20, wherein said contour wire has a circular periphery with a diameter between 2.8 mm and 3.2 mm.

22. A face guard for a hockey helmet, said face guard comprising a contour wire and at least six vertical wires intersecting at least four horizontal wires for defining a curved grid having a concave side for facing a face of a hockey player and having a plurality of apertures, each aperture being sized and configured for preventing a hockey stick or puck from impacting the hockey player's face, wherein each of said contour wire, six vertical wires and four horizontal wires is made of stainless steel are welded and has an inner surface facing the face of the player and an outer surface opposing said inner surface, and wherein said inner surface is mat and said outer surface is shiny.

23. A face guard as defined in claim 22, wherein said at least six vertical wires comprise first, second, third, fourth, fifth, sixth vertical wires and said at least four horizontal wires comprise first, second, third and fourth horizontal wires, each of said first, second, third and fourth vertical wires and first and second horizontal wires having a portion to be at least partially located within a field of view of the eyes of the player, each of said first, second, third and fourth vertical wires and first and second horizontal wires having an elliptical cross-section with a major axis and a minor axis, said major axis being oriented to generally converge towards eyes of the player, wherein a ratio of said minor axis to said major axis is between 0.4 and 0.8, and wherein said face guard weighs between 170 grams and 220 grams.

24. A face guard as defined in claim 23, wherein said contour wire has a peripheral wall defining a hollow interior, said peripheral wall having a thickness between 0.6 mm and 1.0 mm.

* * * * *

UNITED STATES PATENT AND TRADEMARK OFFICE

CERTIFICATE OF CORRECTION

PATENT NO. : 7,836,517 B2
APPLICATION NO. : 11/730213
DATED : November 23, 2010
INVENTOR(S) : Jacques Durocher, Marie-Claude Genereux and Jean-Francois Laperriere It is certified that error appears in the above-identified patent and that said Letters Patent is hereby corrected as shown below:

Claim 1, Line 35: The second "plurality" should read "welded"; and

Claim 15, Line 60: The second "plurality" should read "welded".

Signed and Sealed this
Eighteenth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,836,517 B2
APPLICATION NO. : 11/730213
DATED : November 23, 2010
INVENTOR(S) : Jacques Durocher, Marie-Claude Genereux and Jean-Francois Laperriere It is certified that error appears in the above-identified patent and that said Letters Patent is hereby corrected as shown below:

Claim 1, Column 5, Line 35: The second "plurality" should read "welded"; and

Claim 15, Column 6, Line 60: The second "plurality" should read "welded".

This certificate supersedes the Certificate of Correction issued January 18, 2011.

Signed and Sealed this
Fifteenth Day of February, 2011

David J. Kappos

David J. Kappos
*Director of the United States Patent and Trademark Office*